US007854626B2

(12) United States Patent
Ishida et al.

(10) Patent No.: US 7,854,626 B2
(45) Date of Patent: Dec. 21, 2010

(54) CONNECTION STRUCTURE FOR SMALL DIAMETER SHIELDED CABLE

(75) Inventors: Tetsuro Ishida, Kokubunji (JP); Junichi Tanigawa, Kawasaki (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 341 days.

(21) Appl. No.: 12/053,917

(22) Filed: Mar. 24, 2008

(65) Prior Publication Data

US 2008/0236889 A1 Oct. 2, 2008

(30) Foreign Application Priority Data

Apr. 2, 2007 (JP) ..... 2007-096551

(51) Int. Cl.
*H01R 12/24* (2006.01)

(52) U.S. Cl. ..... 439/497; 439/404

(58) Field of Classification Search ..... 439/39–497
See application file for complete search history.

(56) References Cited

U.S. PATENT DOCUMENTS

| | | | | |
|---|---|---|---|---|
| 6,489,563 | B1 * | 12/2002 | Zhao et al. | 439/497 |
| 6,676,444 | B2 * | 1/2004 | Noro | 439/497 |
| 6,994,583 | B1 * | 2/2006 | Chi-Te | 439/404 |
| 7,001,213 | B2 * | 2/2006 | Kaneko et al. | 439/579 |
| 7,601,029 | B2 * | 10/2009 | Horiuchi et al. | 439/497 |

* cited by examiner

*Primary Examiner*—Briggitte R Hammond
(74) *Attorney, Agent, or Firm*—Barley Snyder LLC

(57) ABSTRACT

A shielded cable connection structure includes a plurality of shielded cables. Each of the shielded cables has a center conductor, a shielding conductor, and an insulative jacket. A metal grounding member has at least two rows of mutually parallel substantially comb shaped teeth. The comb shaped teeth in each of the rows have a wire receiving portion formed there between that receives at least one of the shielded cables. A holding member mates with the metal grounding member to clamp the shielded cables between the metal grounding member and the holding member. The center conductor is directly clamped by the comb shaped teeth in one of the rows, and the shielding conductor is clamped through the insulative jacket by the comb shaped teeth in the other row.

13 Claims, 7 Drawing Sheets

(A)

(B)

CONNECTION STRUCTURE FOR SMALL DIAMETER SHIELDED CABLE

CROSS-REFERENCE TO RELATED APPLICATIONS

This application claims the benefit of the filing date under 35 U.S.C. §119(a)-(d) of Japan Patent Application No. 2007-096551, filed Apr. 2, 2007.

FIELD OF THE INVENTION

The present invention relates to a shielded cable connection structure comprising a metal grounding member that has at least two rows of mutually parallel substantially comb shaped teeth and a holding member that mates with the metal grounding member to clamp the shielded cables between the metal grounding member and the holding member and electrically connect the metal grounding member to the shielded cables.

BACKGROUND

Conventionally, shielded cables having a shielding conductor surrounding one or a plurality of center conductors have been used to transmit high-frequency signals. The shielded cable is effective in suppressing the infiltration of electromagnetic noise from a transmission path and in suppressing electromagnetic interference from signal components that leak from the transmission path to a surrounding periphery. Moreover, in order to transmit high-frequency signals with as little attenuation as possible, a shielded cable having a coaxial structure is used.

The shielded cable has flexibility and is therefore easy to handle, and various types of shielded cables are used in many applications. For example, a shielded cable having an extremely small diameter (so-called thin shielded cable) is used inside information devices to transmit digital signals that contain high frequency components.

However, in the case where a shielded cable is used, in addition to electrically connecting the center conductor and the shielding conductor to the object to be connected, the end of the shielded cable must be secured mechanically. To electrically connect the center conductor and the shielding conductor of the shielded cable, an appropriate fastening method, such as a screw, soldering, insulation displacement connection, crimping and the like, is selected. Moreover, in order to secure the end of the shielded cable mechanically, a portion of the insulation jacket of the shielded cable is often removed in advance to expose the shielding conductor. This exposed portion is pressed by a securing bracket into the ground potential area of the object to be connected. This type of method enables the end of the shielded cable to be mechanically secured to the object to be connected and the shielding conductor of the shielded cable to be connected to the ground potential area.

JP 3-030357U discloses a shielded cable connection structure that uses a block-shaped securing bracket to mechanically secure a plurality of shielded cables arranged in a parallel configuration and to connect the shielding conductor of each of the shielded cables to a ground potential area. Moreover, JP 2001-223039A discloses a shielded cable connection structure wherein the center conductor and the shielding conductor of the shielded cable are connected electrically and mechanically to the object to be connected solely by an insulation displacement connection.

Inside an information device, circuit modules are interconnected by small-diameter shielded cables. The small-diameter shielded cables are extremely flexible and are therefore well-suited for ensuring the freedom of layout inside the framework of a small information device wherein circuit modules must be densely deployed. In particular, the shielded cables have a shielded center conductor and are therefore more advantageous for suppressing the generation of electromagnetic interference than the flexible printed circuit boards and the like used previously. In particular, thin shielded cable is highly flexible, and is therefore indispensable for transmitting high frequency signals through a movable part such as a hinge supporting a liquid crystal display unit in a cell phone or camera.

However, as shown in FIG. 8, the prior art shielded cable connection structure for described in JP 3-030357U uses a single block-shaped bracket 6, 8 to secure the shielded cables 9. In order to use this shielded cable connection structure with extremely small-diameter shielded cables, a U-shaped groove having a depth h1 and a width W that are comparable to the outer diameter ϕD of the shielded cable 9 must be formed in the bracket 6, 8. However, the thin shielded cable wired through the cell phone hinge in the above example has an outer diameter of approximately 300 μm and forming a corresponding U-shaped groove in the block-shaped bracket 6, 8 would therefore be difficult. Thus, application of the shielded cable connection structure described in JP 3-030357U to an extremely small shielded cable would be unrealistic.

Moreover, the prior art connection structure for shielded cable described in JP 2001-223039A uses only insulation displacement connects to connect the center conductor and/or the shielding conductor. However, the diameter of the center conductor of the abovementioned shielded cable with the outer diameter of 300 μm is only approximately 75 μm. As a result, if an extremely small-diameter shielded cable is connected by an insulation displacement connection, not only will an electrically stable connection state be difficult to obtain, but the shielded cable may be damaged. Thus, application of the connection structure described in JP 2001-223039A to an extremely small shielded cable would be unrealistic.

SUMMARY

It is therefore an object of the present invention to provide a shielded cable connection structure for mechanically securing a small-diameter shielded cable, and in particular, a shielded cable connection structure well suited for simultaneously securing a plurality of thin shielded cables arranged in a parallel configuration.

This and other objects are achieved by a shielded cable connection structure comprising a plurality of shielded cables. Each of the shielded cables has a center conductor, a shielding conductor, and an insulative jacket. A metal grounding member has at least two rows of mutually parallel substantially comb shaped teeth. The comb shaped teeth in each of the rows have a wire receiving portion formed there between that receives at least one of the shielded cables. A holding member mates with the metal grounding member to clamp the shielded cables between the metal grounding member and the holding member. The center conductor is directly clamped by the comb shaped teeth in one of the rows, and the shielding conductor is clamped through the insulative jacket by the comb shaped teeth in the other row.

DETAILED DESCRIPTION OF THE EMBODIMENT(S)

Figure 1:
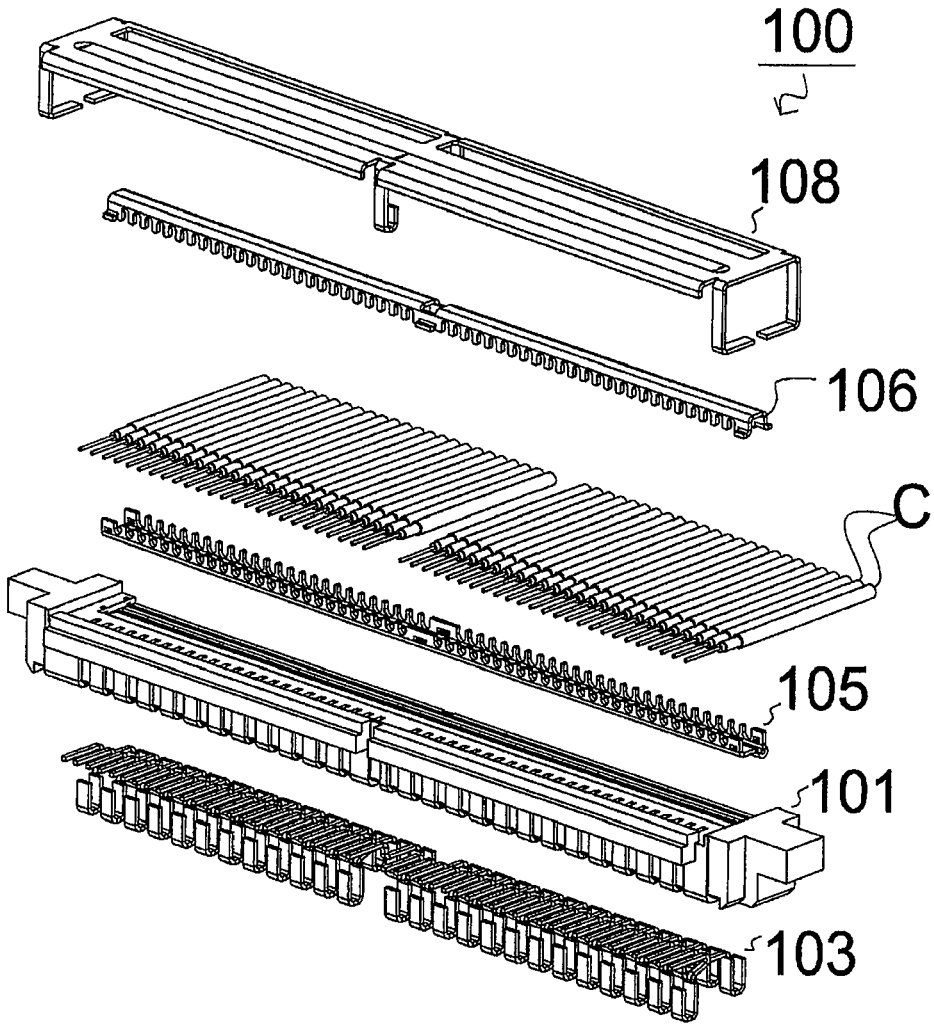
FIG. 1 is an exploded perspective view of a shielded cable connection structure of an electrical connector according to a first embodiment of the present invention.
Figure 2:
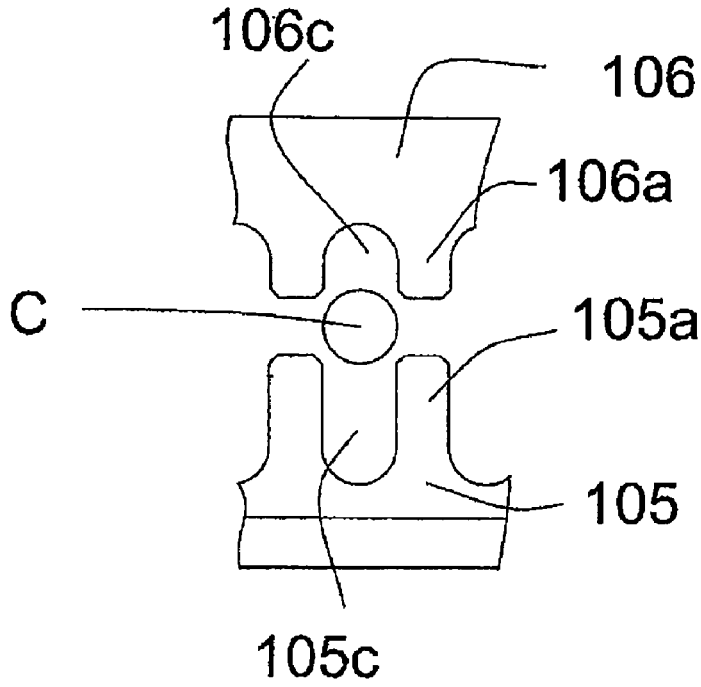
FIG. 2(A) is a schematic diagram showing a shielded cable before being clamped by a grounding member and a holding member of the shielded cable connection structure of FIG. 1.
FIG. 2(B) is a schematic diagram showing the shielded cable clamped by the grounding member and the holding member of the shielded cable connection structure of FIG. 1.
Figure 2:
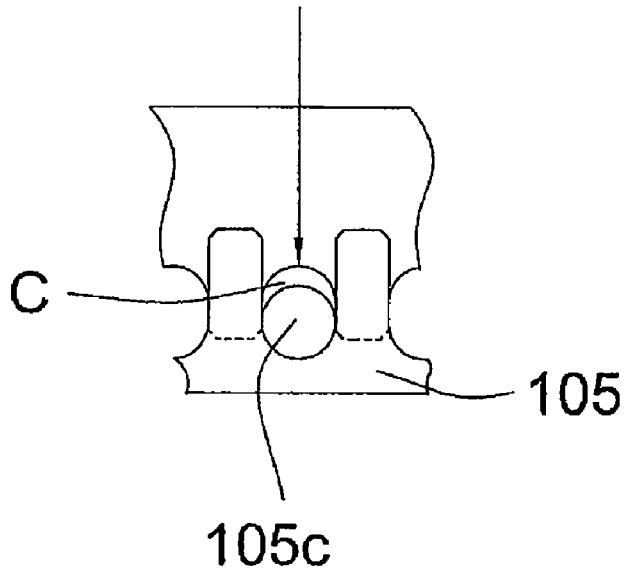
Figure 3:
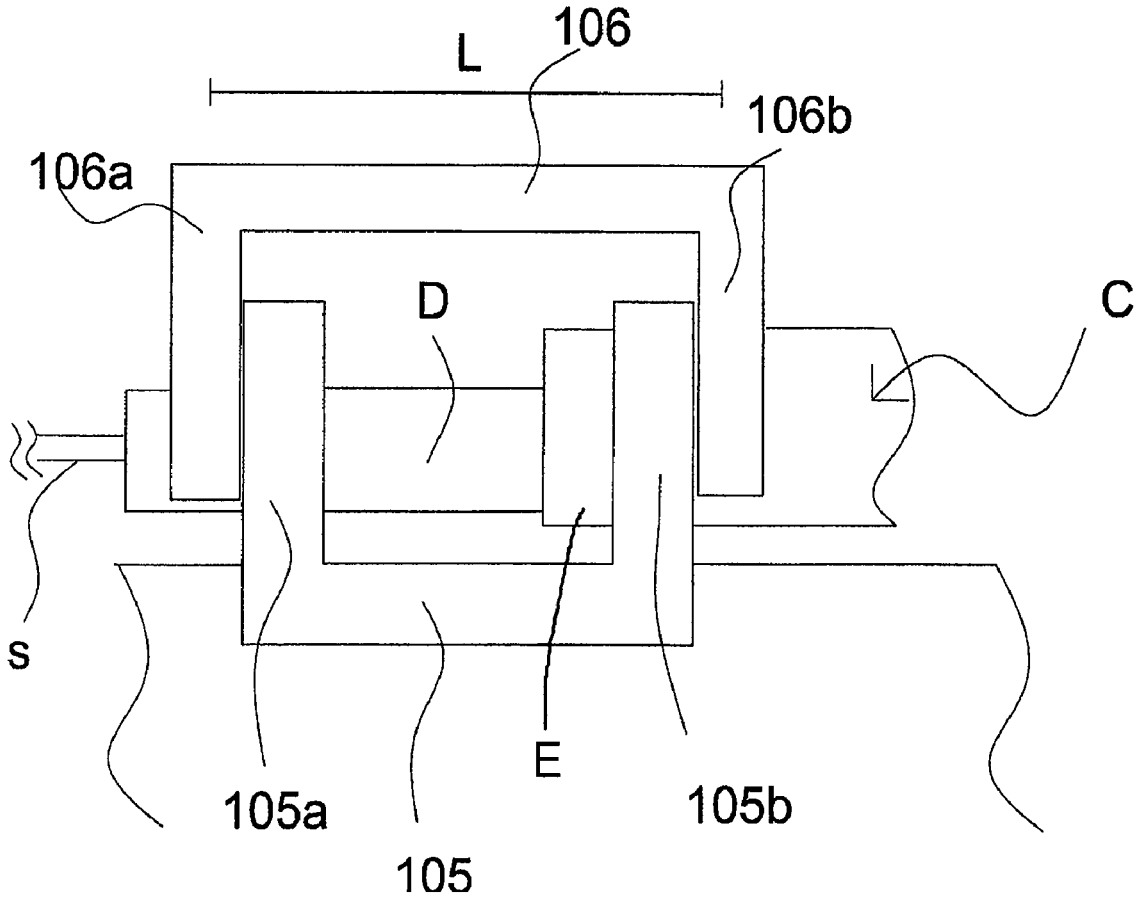
FIG. 3 is a schematic diagram showing the shielded cable clamped by the grounding member and the holding member of the shielded cable connection structure of FIG. 1.

FIGS. 1-4 show a shielded cable connection structure 100 of an electrical connector according to a first embodiment of the present invention that functions as a shielded cable connection structure. As shown in FIG. 1, the shielded cable connection structure 100 is configured to receive a plurality of shielded cables C and comprises an insulating housing 101, a plurality of contacts 103, a grounding member 105, a holding member 106 and a shell 108. The shielded cables C may be, for example, coaxial cables or shielded wires. The shielded cables C consist of a plurality of shielded cables arranged substantially parallel to each other in a single row. The shielded cables C have center conductors S, shielding conductors D and insulative jackets E, as shown in FIG. 3. In the illustrated embodiment, 50 of the shielded cables C are illustrated; however, it will be appreciated by those skilled in the art that any desired number of the shielded cables C may be provided.

As shown in FIG. 1, the insulating housing 101 retains the contacts 103 and the grounding member 105. The insulating housing 101 may be formed, for example, by molding a synthetic resin. The contacts 103 may be formed, for example, by stamping and forming a thin sheet of metal, such as a copper alloy or the like, which has a desired elasticity and good electrical conductivity. The contact 103 may be insert molded or pressed into the insulating housing 101 to make the shielded cable connection structure 100 of a low-profile. As shown in FIG. 3, each of the contacts 103 is connected to the center conductor S of one of the shielded cables C and electrically contacts a mating contact (not shown) of a mating connector (not shown).

As shown in FIG. 1, the grounding member 105 has a substantially channel-like shape and has mutually parallel substantially comb shaped teeth 105*a*, 105*b* arranged in rows. As shown in FIG. 3, the rows are separated by a distance L in an axial direction of the shielded cable C. As shown in FIGS. 1-2(B), a wire receiving portion 105*c* having a substantially U-shaped concave recess is formed between the adjacent comb shaped teeth 105*a*, 105*b* in each of the rows. An open side of the wire receiving portion 105*c* is substantially rectilinear and a bottom portion thereof is substantially arc-shaped. A top of the wire receiving portion 105*c* is substantially beveled so as to facilitate insertion of the shielded cable C therein. The grounding member 105 may be formed, for example, by stamping and forming a metal sheet.

Figure 4:
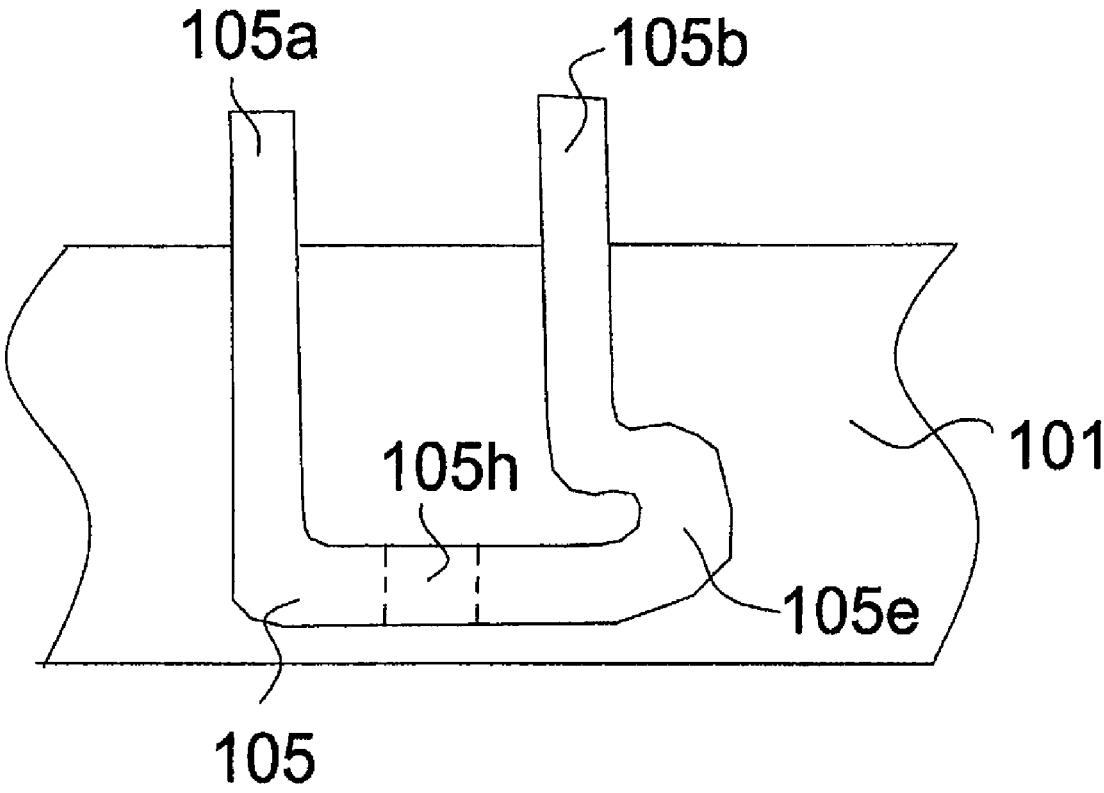
FIG. 4 is a schematic diagram showing the grounding member embedded in the insulating housing of the shielded cable connection structure of FIG. 1.

Additionally, the grounding member 105 may be integrally formed with the insulating housing 101 by insert molding or the like. FIG. 4 shows the grounding member 105 embedded into the insulating housing 101. To reduce the height of the shielded cable connection structure 100, the insulating housing 101 is preferably made as thin as possible. On the other hand, the insulating housing 101 that is integrated with the grounding member 105 is required to be provided with a necessary amount of mechanical strength. To satisfy these conflicting requirements, the grounding member 105 also functions as a reinforcing member that is integrated with the insulating housing 101 by insert molding or the like. The grounding member 105 therefore may have a cross-sectional shape as shown in FIG. 4. In other words, instead of having a simple channel shape, the grounding member 105 is formed with a section 105*e* that bulges outward from at least one bent portion. Another bent portion may be formed into this same shape, but being bent at a right angle as shown in FIG. 4 is usually sufficient. Further, the grounding member 105 is provided with an opening 105*h* in order to improve the flow of a resin while being embedded in the insulating housing 101.

As shown in FIG. 1, the holding member 106 has substantially comb shaped teeth 106*a*, 106*b* arranged in rows that correspond to the rows of the substantially comb shaped teeth 105*a*, 105*b* in the grounding member 105. As shown in FIG. 3, the rows are separated by a distance L in an axial direction of the shielded cable C. As shown in FIGS. 1-2(B), a wire receiving portion 106*c* having a substantially U-shaped concave recess is formed between the adjacent comb shaped teeth 106*a* in each of the rows. The holding member 106 may be formed, for example, by stamping and forming a metal sheet. The holding member 106 is made of a metal sheet having an appropriate elasticity so that the holding member 106 is able to be maintained in the fitted state by the elasticity thereof. Thus, screws or other members for securing the holding member 106 to the grounding member 105 are not necessarily required.

The grounding member 105 and the holding member 106 mate with one another such that the substantially comb shaped teeth 105*a*, 105*b*, 106*a*, 106*b* clamp the shielded cables C there between to establish an electrical connection between the shielding conductors D of the shielded cables. As shown in FIG. 3, the shielded cable C is secured to the shielded cable connection structure 100 in at least two locations by the comb shaped teeth 105*a*, 105*b*, 106*a*, 106*b*. Although FIG. 3 shows the holding member 106 as being fitted so as to cover an exterior of the grounding member 105, it will be appreciated by those skilled in the art that the holding member 106 may also be configured so as to be inserted into an interior of the grounding member 105. The holding member 106 is fitted to the grounding member 105 after the shielded cables C have been inserted between the comb shaped teeth 105*a*, 105*b*, 106*a*, 106*b* of the grounding member 105 and cooperates with the grounding member 105 to mechanically secure an end of each of the shielded cables C to the shielded cable connection structure 100.

Before being clamped by the comb shaped teeth 105*a*, 105*b*, 106*a*, 106*b*, the insulative jacket E has been removed from the shielded cables C proximate the comb shaped teeth 105*a*, 106*a* to expose the shielding conductor D. As a result, the shielding conductor D of the shielded cable C is electrically connected via the grounding member 105 and the holding member 106 to the shell 108. Since the outermost insulative jacket E has not been removed from the shielded cables C proximate the comb shaped teeth 105*b*, 106*b*, an outer diameter of the shielded cables C proximate the comb shaped teeth 105*b*, 106*b* is larger than the outer diameter of the shielded cables C proximate the comb shaped teeth 105*a*, 106*a*. Since the insulative jacket E has elasticity, the comb shaped teeth 105*b*, 106*b* can clamp this area more strongly than the shielding portion D.

As shown on FIG. 1, the shell 108 is made, for example, of metal. After the shielded cables C are secured to the shielded cable connection structure 100 by the grounding member 105 and the holding member 106, the shell 108 is fitted to the insulating housing 101. The shell 108 is configured to make contact with the holding member 106 to establish an electrical connection, via the holding member 106 and the grounding member 105, with the shielding conductors D of each of the shielded cables C. Thus, when mounting the shielded cable connection structure 100 on a circuit board, connecting a part of the shell 108 to a ground potential (reference potential) area will maintain the shielding conductors D of all of the shielded cables C at ground potential.

A procedure for electrically connecting and mechanically securing the shielded cable C to the shielded cable connection structure 100 will now be described. First, the insulative jacket E, the shielding conductor D, and dielectric material at a distal portion of the shielded cable C are removed over a predetermined length so that the center conductor S protrudes outward. A predetermined length of the insulative jacket E is also removed to expose the shielding conductor D at an adjoining portion.

The shielded cable C is then placed in the wire receiving portion 105*c* of the grounding member 105. The wire receiving portion 105*c* has a width such that the shielded cable C is retained therein and does not fall out of the grounding member 105 when the exposed portion of the shielding conductor D and the insulative jacket E of the adjoining portion of the shielded cable C are clamped on both sides by the comb shaped teeth 105*a*, 105*b*. Although dependent on the outer diameter of the shielded cable C, an appropriate width for the wire receiving portion 105*c* is approximately ½ of the original thickness of the outer jacket (on one side). Forming the wire receiving portion 105*c* with such a width enables a plurality of the shielded cables C to be placed in the wire receiving portions 105*c*.

The holding member 106 is then fitted to and pressed down onto the grounding member 105 in which the shielded cables C have been inserted in the wire receiving portion 105*c*. As a result, the shielded cables C are connected to the shielded cable connection structure 100 all at once. Then, the wire receiving portions 105*c* of the grounding member 105 and the wire receiving portions 106*c* of the holding member 106 are closed together to constrict the outer periphery of the shielded cables C. The bottoms of the wire receiving portions 105*c* and the wire receiving portions 106*c* are formed in a circle which diameter is slightly smaller than the outer diameter of a portion of the shielded cable retained when the shielded cable C is clamped from above and below. In other words, the shielded cable C is constricted over its entire periphery by the grounding member 105 and the holding member 106. This condition applies not only to the comb shaped teeth 105*a*, 106*a*, but is also the same for the comb shaped teeth 105*b*, 106*b*. In other words, the shielded cable C is secured to the insulating housing 101 in at least two locations along an axial direction. Thus, the shielding conductor D of the shielded cable C that is clamped from above and below by the comb shaped teeth 105*a*, 106*a*, can be connected to a ground potential (reference potential) area, and is mechanically retained in the housing 101.

The center conductor S of the shielded cable C is then soldered to the contacts 103 to form an electrical connection therewith. Of course other known methods may be used to form an electrical connection with the center conductor S. The metal shell 108 is then fitted on the insulating housing 101 to complete the assembly of the shielded cable connection structure 100.

Figure 5:
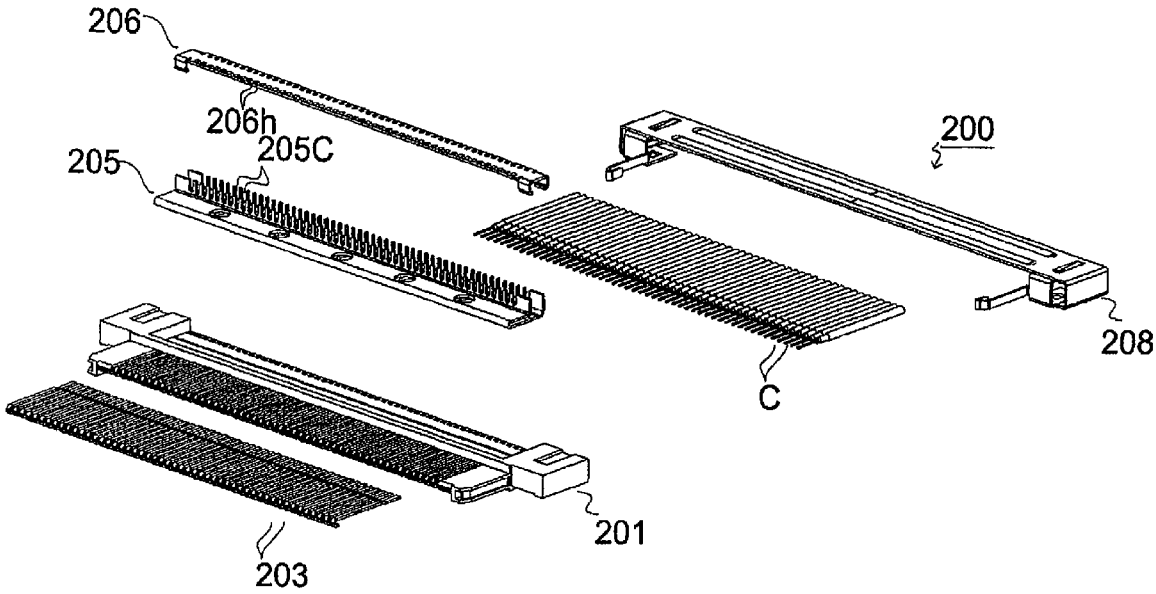
FIG. 5 is an exploded perspective view of a shielded cable connection structure of an electrical connector according to a second embodiment of the present invention.
Figure 6:
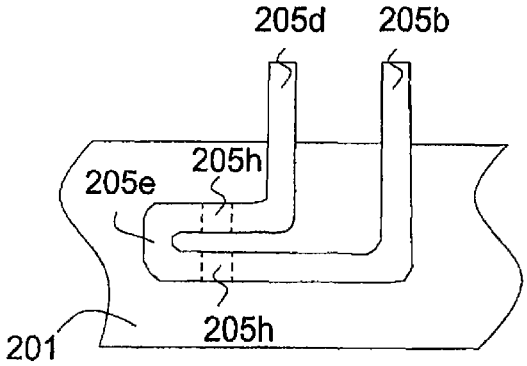
FIG. 6 is a schematic diagram showing the grounding member embedded in the insulating housing of the shielded cable connection structure of FIG. 5.

FIGS. 5-6 show a shielded cable connection structure 200 of an electrical connector according to a second embodiment of the present invention that functions as a shielded cable connection structure. Elements of the shielded cable connection structure 200 that are identical to the shielded cable connection structure 100 according to the first embodiment of the present invention will not be described in further detail hereafter.

As shown in FIG. 5, the shielded cable connection structure 200 comprises an insulating housing 201, a plurality of contacts 203, a grounding member 205, a holding member 206, and a shell 208. The insulating housing 201 retains the contacts 203 and the grounding member 205. The insulating housing 201 may be formed, for example, by molding a synthetic resin. Each of the contacts 203 is electrically connected to the center conductor S of the shielded cable C and electrically contact a mating contact (not shown) of a mating connector (not shown).

The grounding member 205 is formed, for example, by processing a metal sheet and has mutually parallel substantially comb shaped teeth 205*d*, 205*b* arranged in rows. The grounding member 205 has a cross-sectional shape in which a section of a doubled metal sheet is elongated outward from a bent portion thereof to form a base that is substantially perpendicular to the comb shaped teeth 205*d*, 205*b*. Wire receiving portions 205*c* of the grounding member 205 are a substantially U-shaped, but the holding member 206 has a plate shape. Hence, the shielded cables C retained by the comb shaped teeth 205*d*, 205*b* of the grounding member 205 are enclosed by a semicircular-shaped edge formed by the grounding member 205 and the holding member 206. This condition applies not only to the comb shaped teeth 205*a*, but also the comb shaped teeth 205*b*.

As shown in FIG. 6, the grounding member 205 may be integrally formed with the insulating housing 201 by insert molding or the like. In order to reduce the height of the shielded cable connection structure 200, the insulating housing 201 is made as thin as possible. On the other hand, the insulating housing 201 that is integrated with the grounding member 205 is required to be provided with a necessary amount of mechanical strength. To satisfy these conflicting requirements, the grounding member 205 has a base 205*e* formed of a doubled metal sheet that bulges outward from at least one bent portion. Both bent portions may be formed with the same shape, but the shape of one of the bent portions is bent at a substantially right angle. The base 205*e* is provided with openings 205*h* to improve the flow of a resin that constitutes the insulating housing 201 and is configured so as to allow the inflow of the resin that constitutes the insulating housing 201. As a result, the grounding member 205 is securely integrated with the insulating housing 201.

The holding member 206 is provided with a plurality of openings 206*h* that receive each of the comb shaped teeth 205*d*, 205*b* of the grounding member 205. The holding member 206 does not have comb shaped teeth and is configured as a nearly flat surface, and is therefore easier to construct than the holding member 106. Moreover, the absence of the comb shaped teeth enables the shielded cable connection structure 200 to have a lower height than the shielded cable connection structure 100.

The shielded cables C inserted between the comb shaped teeth 205*d*, 205*b* of the grounding member 205 are clamped by the comb shaped teeth 205*d*, 205*b* of the grounding member 205 and are constricted from above and below by cooperation of the grounding member 205 with the holding member 206. After the shielded cable C is secured by the grounding member 205 and the holding member 206 is secured to the shielded cable connection structure 200, the shell 208 is fitted to the insulating housing 201. The shell 208 establishes an electrical connection, via the holding member 206 and the grounding member 205, with the shielding conductors D of each of the shielded cables C.

Figure 7:
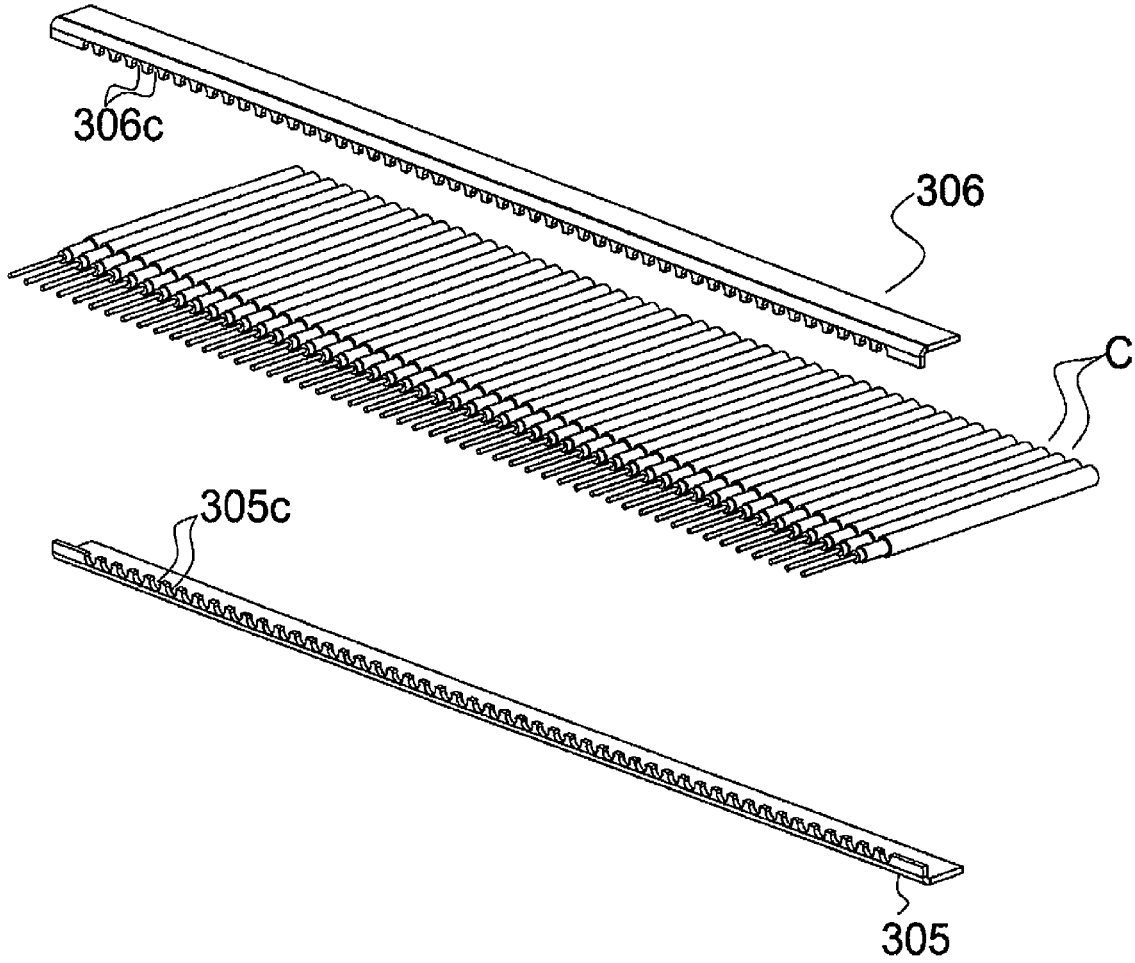
FIG. 7 is an exploded perspective view of a shielded cable connection structure of an electrical connector according to a third embodiment of the present invention.
Figure 8:
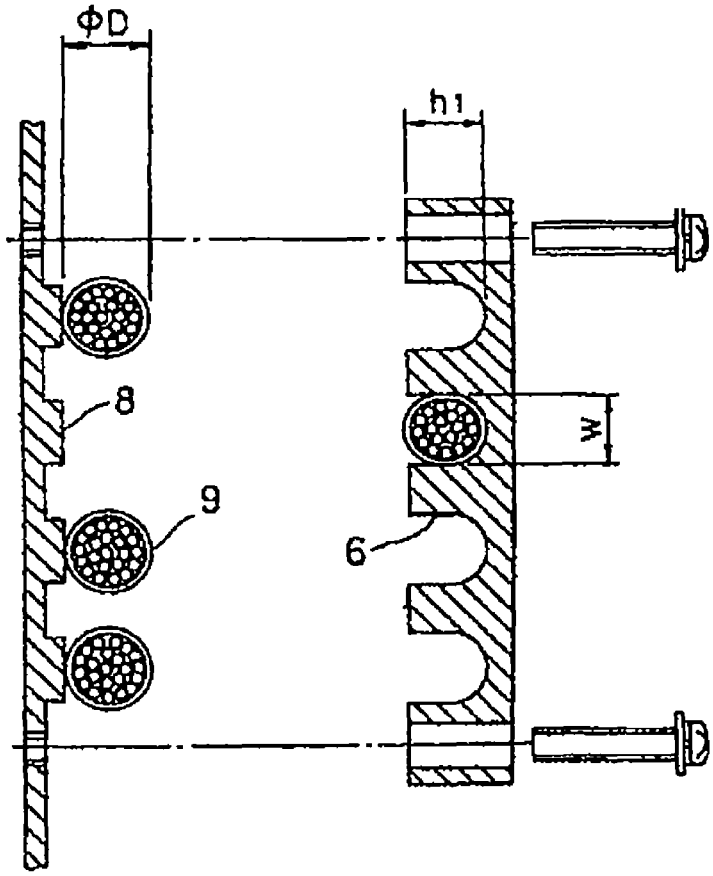
Fig. 8 Prior Art
FIG. 8 is a cross-section view of a shielded cable connection structure according to the prior art.

FIG. 7 shows a shielded cable connection structure 300 of an electrical connector according to a third embodiment of the present invention that functions as a shielded cable connection structure. Elements of the shielded cable connection structure 300 that are identical to the shielded cable connection structure 100 according to the first embodiment of the present invention will not be described in further detail hereafter.

As shown in FIG. 7, the grounding member 305 and the holding member 306 are constructed, for example, from a metal sheet having a substantially L-shaped cross-section. The grounding member 305 and the holding member 306 are provided with the comb shaped teeth, which have wire receiving portions 305*c*, 306*c* formed in the vertical portions bent at a right angle to the bottom surfaces thereof. The wire receiving portions 305*c*, 306*c* are substantially semicircular-shaped concave recesses and are configured so as to form a substantially circular-shaped wire retaining portion when the grounding member 305 and the holding member 306 abut each other.

After the shielded cables C have been inserted into the wire receiving portions 305*c* of the grounding member 305 positioned on the lower side, the holding member 306 is fitted to the grounding member 305. Then, after the shielded cables C are clamped by the grounding member 305 and the holding member 306, an adhesive resin (not shown) is filled between the grounding member 305 and the holding member 306. In other words, instead of embedding the grounding member 305 into the insulating housing of the shielded cable connection structure 300 in advance, the adhesive resin (not shown) integrates the grounding member 305 and the holding member 306 after clamping the shielded cables C. This configuration is suitable for situations in which the outer diameter of the shielded cables C is relatively large. Furthermore, the grounding member 305 may also be embedded into the insulating housing in advance, or may be attached to the insulating housing after the shielded cables C have been clamped between the grounding member 305 and the holding member 306.

The wire receiving portions formed by the mutually adjacent comb shaped teeth may be provided with arrow-shaped barbs to hold the shielded cables C securely. Moreover, screws, adhesives and other known methods can be used for securing the grounding member 305 to the insulating housing. The shielded cable connection structure 300 thereby has a lower height than the height of the shielded cable connection structure 100 and the shielded cable connection structure 200.

With the shielded cable connection structures of the present invention, the shielded cable C, regardless of its outer diameter, can be connected to the object to be connected. In particular, even if the shielded cable C is a thin shielded cable having a center conductor S with a diameter of about 75 μm or smaller, the shielded cable C can be securely connected electrically and mechanically without damaging the center conductor S. Moreover, with the shielded cable connection structure of the present invention, a plurality of the shielded cables C arranged in a parallel configuration can be secured all at once without enlarging an interval between the shielded cables C.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A shielded cable connection structure, comprising:

a plurality of shielded cables each having a center conductor, a shielding conductor, and an insulative jacket;

a metal grounding member having at least two rows of mutually parallel substantially comb shaped teeth, the comb shaped teeth in each of the rows having a wire receiving portion formed there between that receives at least one of the shielded cables; and a holding member that mates with the metal grounding member to clamp the shielded cables between the metal grounding member and the holding member, the shielding conductor being directly clamped by the comb shaped teeth in one of the rows and the shielding conductor being clamped through the insulative jacket by the comb shaped teeth in the other row;

wherein the holding member has at least two rows of mutually parallel substantially comb shaped teeth corresponding to the comb shaped teeth of the metal grounding member, the comb shaped teeth in each of the rows of the holding member having a wire receiving portion formed there between that receives at least one of the shielded cables.

2. The shielded cable connection structure of claim 1, wherein the center conductor has a diameter of about 75 μm or smaller.

3. The shielded cable connection structure of claim 1, wherein the shielded cables are coaxial cables.

4. The shielded cable connection structure of claim 1, wherein the wire receiving portion of the metal grounding member is a substantially U-shaped concave recess.

5. The shielded cable connection structure of claim 1, wherein the holding member is metal.

6. The shielded cable connection structure of claim 1, wherein the rows of comb shaped teeth of the holding member are arranged to an exterior of the rows of comb shaped teeth of the metal grounding member.

7. The shielded cable connection structure of claim 1, wherein the rows of comb shaped teeth of the holding member are separate by a distance larger than the rows of comb shaped teeth of the metal grounding member with respect to an axial direction of the shielded cable.

8. The shielded cable connection structure of claim 1, wherein the holding member has a plurality of openings that receive each of the comb shaped teeth of the metal grounding member.

9. The shielded cable connection structure of claim 1, wherein the metal grounding member has a substantially L-shaped cross-section.

10. The shielded cable connection structure of claim 1, further comprising an insulating housing, the metal grounding member being embedded in the insulating housing.

11. The shielded cable connection structure of claim 1, further comprising a metal shell electrically connected to the metal grounding member.

12. The shielded cable connection structure of claim 1, further comprising an insulating housing provided with contacts, the contacts being electrically connected to the shielded cables.

13. The shielded cable connection structure of claim 1, wherein the wire receiving portion of the holding member is a substantially U-shaped concave recess.

* * * * *